US006464269B1

(12) United States Patent
Wilhelm et al.

(10) Patent No.: US 6,464,269 B1
(45) Date of Patent: Oct. 15, 2002

(54) SECURITY SEAL AND REMOVAL TOOL

(76) Inventors: Richard E. Wilhelm, 14606 Cuming St., Omaha, NE (US) 68154; Kevin Jorgensen, 3031 S. 105th Ave., Omaha, NE (US) 68124

( * ) Notice: Subject to any disclaimer, the term of this patent is extended or adjusted under 35 U.S.C. 154(b) by 0 days.

(21) Appl. No.: 09/793,605

(22) Filed: Feb. 27, 2001

(51) Int. Cl.[7] ..... B65D 27/30

(52) U.S. Cl. ..... 292/307 R; 292/327; 292/281; 292/331; 292/318; 70/56; 70/2; 70/34

(58) Field of Search ..... 70/54–56, 2, 9–12, 70/32–34; 292/307 R, 318–321, 327, 331, 281

(56) References Cited

U.S. PATENT DOCUMENTS

| | | | | |
|---|---|---|---|---|
| 3,730,578 A | * | 5/1973 | Gerlach | 292/318 |
| 4,626,009 A | | 12/1986 | Burnett et al. | |
| 4,690,443 A | | 9/1987 | Brammall | |
| 4,802,700 A | | 2/1989 | Stevenson et al. | |
| 4,936,612 A | | 6/1990 | Kohn | |
| 5,118,149 A | | 6/1992 | Emmons | |
| 5,413,393 A | | 5/1995 | Georgopoulos et al. | |
| 5,450,776 A | | 9/1995 | Kozak | |
| 5,553,904 A | | 9/1996 | Lorenzo | |
| 5,732,989 A | | 3/1998 | Stevenson et al. | |
| 5,749,610 A | | 5/1998 | Brammall et al. | |
| 5,769,470 A | * | 6/1998 | Toyomura | 292/327 |
| 5,865,014 A | | 2/1999 | Citron et al. | |
| 5,878,604 A | | 3/1999 | Stone et al. | |
| 5,975,595 A | | 11/1999 | Lorenzo | |
| 6,009,731 A | | 1/2000 | Emmons et al. | |
| 6,038,952 A | | 3/2000 | Citron et al. | |

FOREIGN PATENT DOCUMENTS

| | | | |
|---|---|---|---|
| AT | 107771 | * 11/1927 | 292/327 |
| DE | 330460 | * 12/1920 | 292/327 |

* cited by examiner

*Primary Examiner*—Teri Pham Luu
(74) *Attorney, Agent, or Firm*—Rothwell, Figg, Ernst & Manbeck, P.C.

(57) ABSTRACT

A tamper resistant security device, a removal tool, and methods of engaging and disengaging the tamper resistant security device are provided. The tamper resistant security device includes a locking pin including a head, a shaft, and a groove, a locking cap comprising a blind hole, a groove formed inside and substantially coaxial with the blind hole, and a snap ring fitting within the groove and further capable of snapping into the groove of the locking pin. A protective cover includes a closure device cavity, a locking pin hole extending through the protective cover, a locking cap cavity, and an alignment hole. During assembly, the protective cover is placed over the closure device, the locking pin passes through the locking pin hole, and the locking cap is placed in the locking cap cavity and the snap ring of the locking cap is retained in the locking groove of the locking pin. The removal tool fits over the tamper resistant security device and includes a punch pin that is capable of punching through the locking cap, dislodging the locking pin from the locking cap, and thereby disengaging the tamper resistant security device.

27 Claims, 8 Drawing Sheets

SECURITY SEAL AND REMOVAL TOOL

BACKGROUND OF THE INVENTION

1. Field of the Invention

The present invention relates generally to a security seal, and more particularly to a security seal and a removal tool for a security seal.

2. Description of the Background Art

Industrialization has resulted in many new forms of commerce. Shipping is a business that is needed to provide raw materials to industry, which are usually not situated at the source of raw materials. Furthermore, shipping is required to transport completed components to other industrial sites, and is needed to transport completed goods and products to consumers. Therefore, the transfer of cargo is a large business that handles a huge volume of goods and materials every day.

One of the areas in which shipping efficiency has been improved is through the numerous modes of transportation. In addition, efficiency has been improved by the development of shipping containers. Numerous types of common and specialized shipping containers exist. One example is the rail car container that is used to transport cargo, including by ship, train, truck, and even aircraft. These containers make shipping and handling efficient by transporting numerous small or bulk items and by allowing uniform handling of items. Containers additionally prevent damage and theft.

A recurring problem in shipping is vandalism and theft. Because of the massive amounts of material that are shipped every day, including shipment of expensive finished consumer goods, thievery is an attractive occupation. Many thieves are professionals who have made it their trade to know the shipping process and to know how to defeat security measures.

Thievery is a problem because shipping may involve periods of storage while in transit, and shipping may go through deserted areas where it is fairly easy to access trucks, trains, storage yards, etc. Therefore, there may be many opportunities for thieves to break into any manner of shipping container and steal items. For example, common shipping containers used for sea and truck and rail transport are generally too big for the container to be stolen, but all the containers, of course, have an access door and a security device that may be broken into. Professional thieves know how to quickly, quietly, and efficiently break into any manner of shipping container. Therefore, there is a constant need for effective security devices that have a reasonable cost. It is possible to make containers so difficult to get into that thieves cannot easily access them, but that is often at the price of making it also difficult and costly for the shipper to likewise open a container at the end of its journey.

A very basic requirement of a security device is that it should require a thief to have large, expensive and/or bulky tools to defeat the security device. Another consideration is that the security device should take a long time to defeat. Thieves know that even a small amount of extra time greatly increases the chance of getting caught. The main goal of most security devices is not to make access impossible but to make it time-consuming and uneconomical.

FIG. 1 shows a typical hasp 100 used for closing many types of container doors, including doors on shipping containers, trucks, rail cars, warehouses, etc. A hasp is a type of a closure device that is defined as a hinged metal fastening for a door, window, lid, etc., or a clasp that passes over a staple to be fastened by a padlock, hook, pin, etc.

There are many variations to the basic hasp concept, including variations in size and shape, etc. The hasp 100 typically includes a plate 103 mounted to the structure by fasteners 106 and upon which is pivotally mounted a pivoting tongue 110. The hasp 100 further includes a pivoting bar 121 that can be engaged with the pivoting tongue 110. The pivoting bar 121 is pivotally attached to a door or structural member by a fastener 126, and may control a cam-type or tongue-type closure device that may hold a door or doors in place. A lock or other type of security device may be used to secure the door or doors by removably fastening the pivoting bar 121 to the pivoting tongue 110. The lock may pass through the hole 112 in the pivoting tongue 110 and through the hole 129 in the pivoting bar 121. The lock may therefore prevent movement of the pivoting bar 121 with respect to the plate 103.

A padlock (not shown) has been commonly used for securing a hasp 100. Although a padlock is cheap and is easy for the shipper to remove at a destination, it is also easily, quickly, and quietly cut by thieves. A padlock may be removed by a blow or impact, or by use of a portable, hand held cutting tool of some sort.

A newer variation of a lock for a hasp is a locking pin (not shown) that has a head on one end. A cap may snap onto the other end of the locking pin to prevent the locking pin from being removed from the hasp 100. However, like the padlock, the locking pin can be easily broken or cut by bolt cutters or other cutting means.

As a result of the great need for economical and effective security devices, additional components have been developed to reduce the vulnerabilities of hasps and locking devices. A covered device as shown in Emmons et al., U.S. Pat. No. 6,009,731, minimizes access to the padlock and to the hasp. The device of Emmons restricts access to the hasp and lock, but does not block access.

Further prior art devices are shown in Emmons, U.S. Pat. No. 5,118,149, and in Stone et al., U.S. Pat. No. 5,878,604. Both show a cover that limits access to a locking pin. The drawback of these two devices is that they both still allow some access to the locking pin. Neither are designed in such a way that the locking pin can be inserted and locked without allowing thieves some room to access both ends of the locking pin. Worse yet, both ends of the pin are shaped to allow a thief to grasp and manipulate the ends in some manner. If a thief can grasp a head or a locking cap, the thief can still break the security locking pin and gain entry. Therefore, these two devices are still vulnerable to breakage.

Yet another prior art approach is shown in Burnett et al., U.S. Pat. No. 4,626,009. The cover of Burnett is a box-like structure with five sides and an open side for receiving two tongues having holes which the locking pin passes through. Therefore, the device of Burnett will not work with a conventional hasp or conventional door enclosure and requires two tongues that meet up in a certain configuration. The device of Burnett will not work with a common hasp or other container closures having a pivoting rotating hand bar or handle as part of the closure mechanism.

Burnett shows a cover having only one access hole. The one access hole in the cover allows a locking pin to be inserted. The pin is driven into the hole. However, there is no allowance for pin removal. Cover removal requires a cutting torch or cutting tool and the cover must be cut off, potentially damaging the door and/or the closure device. The removal is therefore very time-consuming, expensive, and difficult. Although it may make access by a thief difficult, it also makes opening by the shipper expensive and difficult.

What is needed, therefore, are improvements in security for shipping containers and container access doors.

SUMMARY OF THE INVENTION

A tamper resistant security device for a closure device is provided according to one embodiment of the invention. The tamper resistant security device comprises a locking pin including a head, a shaft, and a groove. The tamper resistant security device further comprises a locking cap comprising a blind hole, a groove formed inside and substantially coaxial with the blind hole, and a snap ring fitting within the groove and further capable of snapping into the groove of the locking pin. The tamper resistant security device further comprises a protective cover comprising a closure device cavity, a locking pin hole extending through the protective cover, a locking cap cavity, and an alignment hole. During assembly, the protective cover is placed over the closure device, the locking pin passes through the locking pin hole, and the locking cap is placed in the locking cap cavity and the snap ring of the locking cap is retained in the locking groove of the locking pin. The closure device cavity is of a size and clearance to substantially prevent access to the closure device when assembled on the closure device. Only the head of the locking pin and a substantially flat end of the locking cap are exposed when the locking pin, the locking cap, and the protective cover are assembled.

A removal tool for disengaging a tamper resistant security device is provided according to one embodiment of the invention. The removal tool comprises a body including a cavity capable of receiving a tamper resistant security device comprising a protective cover, a locking pin, and a locking cap. The removal tool further comprises a punch pin supported by the punch pin hole and axially movable at least partially into the cavity. The removal tool further comprises a punch pin hole formed in a wall of the body and a punch pin actuator communicating with the punch pin and capable of axially moving the punch pin. The removal tool further comprises a first alignment pin and a first alignment pin hole positioned in the body. The first alignment pin is supported by the body and is axially movable at least partially into the cavity, with the first alignment pin capable of engaging an alignment hole in the protective cover and operating to retain the removal tool in a predetermined position with respect to the protective cover. The removal tool further comprises a second alignment pin and two second alignment pin holes formed in opposite sides of the body. When the second alignment pin resides in the two second alignment pin holes, the second alignment pin traps the protective cover in the cavity of the body. During disengagement, the protective cover is therefore positioned between a back cavity surface of the body and the second alignment pin. The punch pin, driven by the punch pin actuator, is capable of punching through the locking cap, dislodging the locking pin from the locking cap, and thereby disengaging the tamper resistant security device.

A method of disengaging a tamper resistant security device using a removal tool is provided according to one embodiment of the invention. The tamper resistant security device includes a protective cover, a locking pin, and a locking cap. The method comprises the steps of engaging at least two alignment pins to hold the removal tool in a predetermined position with respect to the protective cover, actuating a punch pin to move axially into contact with the locking cap, and punching through an endwall of the locking cap to dislodge the locking pin from the locking cap. The removal tool provides a punching force sufficient to punch through the locking cap and dislodge the locking pin.

A method of engaging a tamper resistant security device with a closure device in order to lock the closure device is provided according to one embodiment of the invention. The tamper resistant security device includes a protective cover, a locking pin, and a locking cap. The method comprises the steps of placing the protective cover over the closure device, the protective cover including a closure device cavity that substantially encloses at least a portion of the closure device. The method further comprises the step of inserting a locking pin through a locking pin hole in the protective cover. The locking pin is capable of passing through corresponding apertures in the closure device in order to lock the closure device. A distal end of the locking pin is thereby positioned within a locking cap cavity in the protective cover. The method further comprises the step of inserting a locking cap into the locking cap cavity in the protective cover and over the distal end of the locking pin. The method further comprises the step of pressing the locking cap onto the locking pin until a snap ring positioned in a groove in the locking cap engages a corresponding snap ring groove in the distal end of the locking pin. The protective cover locks and substantially encloses the closure device.

The above and other features and advantages of the present invention will be further understood from the following description of the preferred embodiments thereof, taken in conjunction with the accompanying drawings.

DETAILED DESCRIPTION OF THE PREFERRED EMBODIMENTS

Figure 1:
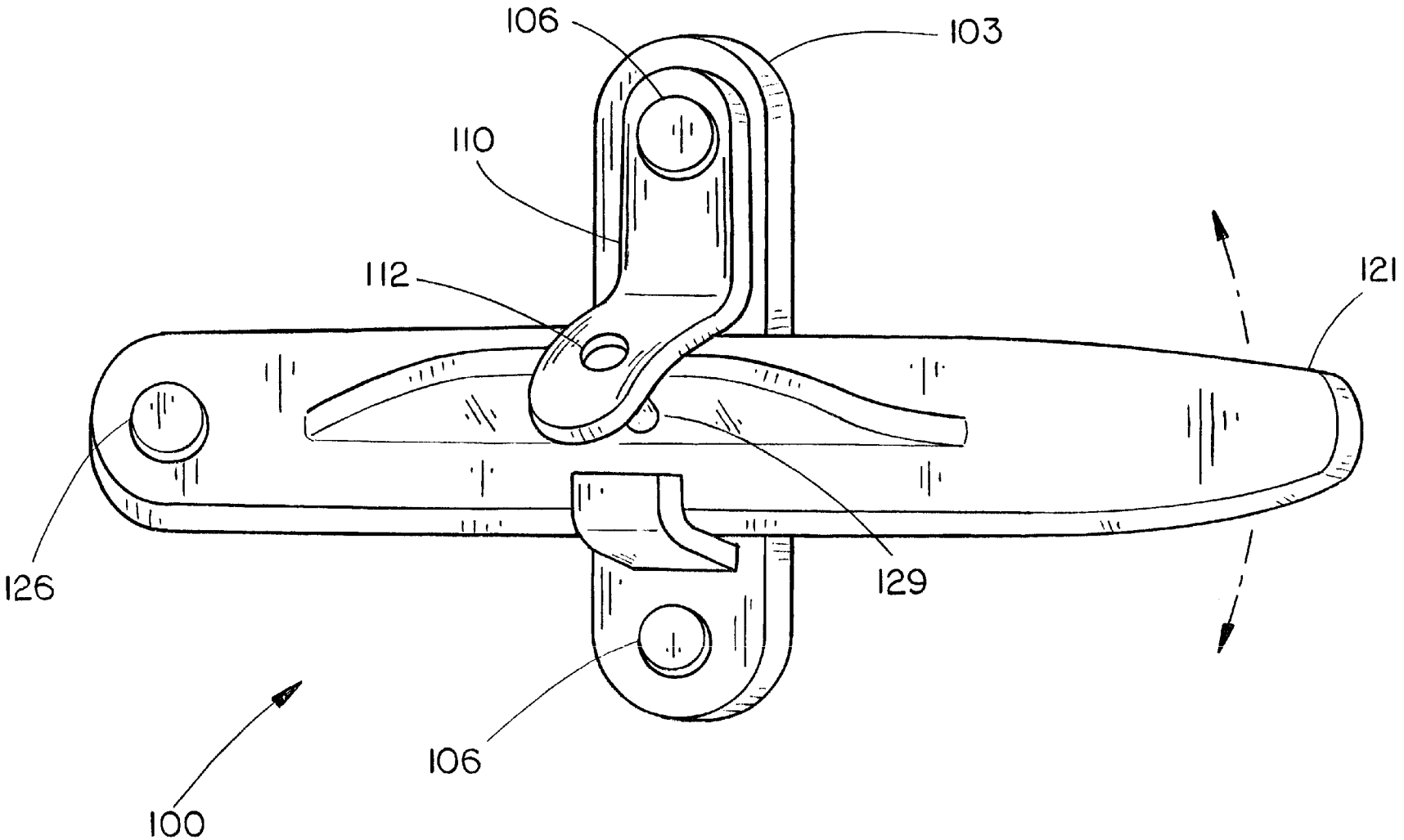
FIG. 1 shows a typical hasp used for closing many types of container doors, including doors on shipping containers, trucks, rail cars, warehouses, etc.
Figure 2:
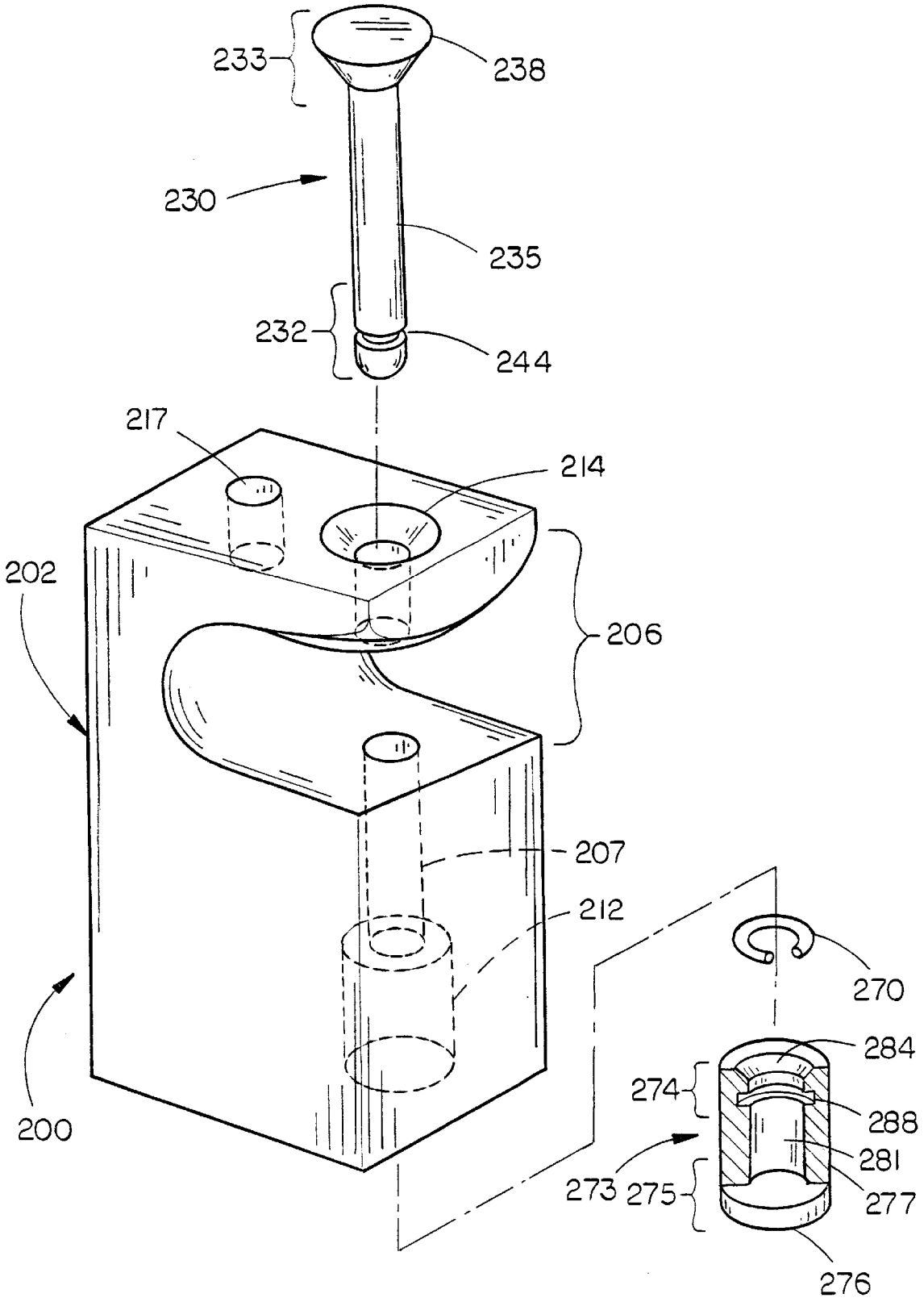
FIG. 2 is an exploded view showing a tamper resistant security device for a closure device, such as the hasp.

FIG. 2 is an exploded view showing a tamper resistant security device 200 for a closure device, such as the hasp 100. The tamper resistant security device 200 includes a protective cover 202, a locking pin 230, and a locking cap 273.

The protective cover 202 may be substantially solid or may include one or more hollow interior regions to reduce weight. Alternatively, the protective cover 202 may be formed as a shell. The protective cover 202 in one embodiment is a substantially rectangular cubic shape.

The protective cover 202 includes a closure device cavity 206 that may be of a predetermined shape, depth, contour, etc., to accommodate a hasp or other closure device having at least two parts. The closure device cavity 206 generally fits over the pivoting tongue 110 and the bar 121 of the hasp 100. The closure device cavity 206 may be a universal shape capable of accommodating a variety of closure devices. Alternatively, the closure device cavity 206 may be designed specifically for a particular closure device shape. The closure device cavity 206 in one embodiment includes an essentially convex upper surface, an essentially flat rear surface, and an essentially concave lower surface (as shown). This shape may ensure a minimal clearance between the protective cover 202 and the closure device.

Also included in the protective cover 202 is an alignment hole 217, a locking pin hole 207 having a countersink or chamfer 214 on one end thereof, and a locking cap cavity 212 on the other end. The locking pin hole 207 passes through the closure device cavity 206. The closure device cavity 206 is configured such that holes in the closure device may be aligned with the locking pin hole 207.

The various holes and pins may be substantially circular, as shown, or may be of other shapes, such as substantially ovoid, rectangular, irregular, etc., and may include splines, ridges and grooves, etc., for purposes of alignment and to prevent rotation of the pins.

The locking pin 230 includes a shaft 235, a head 238 at a proximal end 233, and a groove 244 on a distal end 232. The locking pin 230 is of a size to fit into the locking pin hole 207. The distal end 232 may include a beveled or rounded end to aid in insertion into the protective cover 202 and also into the locking cap 273. The head 238 is of a shape to conformably fit into the countersink 214 with minimal clearance and essentially no protrusion. In the case of the tapered countersink 214 shown in the figure, for example, the head 238 is preferably frustoconical in shape with a flat circular top and tapered sides of decreasing diameter in the distal direction. Correspondingly, the countersink 214 may comprise a tapered hole.

It should be noted that the head 238 of the locking pin 230 and the countersink 214 of the protective cover 202 may be other shapes, sizes, and configurations than what is shown. Shapes allowing rotation are preferred, such as flat cylindrical head (like the head of a nail), etc.

The locking cap 273 may be substantially cylindrical and is of an outside diameter to fit conformably into the locking cap cavity 212, preferably with a minimal clearance and essentially no protrusion. The locking cap cavity 212 may likewise be a substantially cylindrical bore.

The locking cap 273 includes a blind central bore 281 of a size to accommodate the locking pin 230, an endwall 276, a groove 288, and an optional chamfer 284. The blind central bore 281 includes an open proximal end 274 and a closed distal end 275. The endwall 276 at the distal end 275 is designed to be punctured by application of a pressure greater than some predetermined value, while the rest of the locking cap 273 is designed to withstand such pressure without significant deformation. The groove 288 and the chamfer 284 are preferably relative to the proximal end 274 of the locking cap 273. The locking cap 273 further includes a snap ring 270 that resides in the groove 288. The snap ring 270 may be formed of steel or spring steel, for example. The chamfer 284 guides the locking pin 230 into the blind central bore 281 during insertion of the locking pin 230. It should be noted that the locking cap 273 may be formed of other shapes, including ovoid, rectangular, irregular, etc.

The snap ring 270 may be any cross-sectional shape, such as circular, ovoid, rectangular, etc. The cross-sectional shape may affect the required punching force, and may therefore be chosen to help achieve a predetermined punching force required to separate the locking pin 230 and the locking cap 273.

The various components of the tamper resistant security device 200 may be made of any suitable material, but preferably something of sufficient hardness to prevent it from being easily broken, distorted, or punched through. A high quality steel may be used, such as a 1018 steel, for example, and some form of hardening, such as case hardening, tempering, etc., may be employed on any or all of the components.

Each tamper resistant security device 200 may be formed with a unique serial number for purposes of tracking and prevention of theft, etc.

Figure 3:
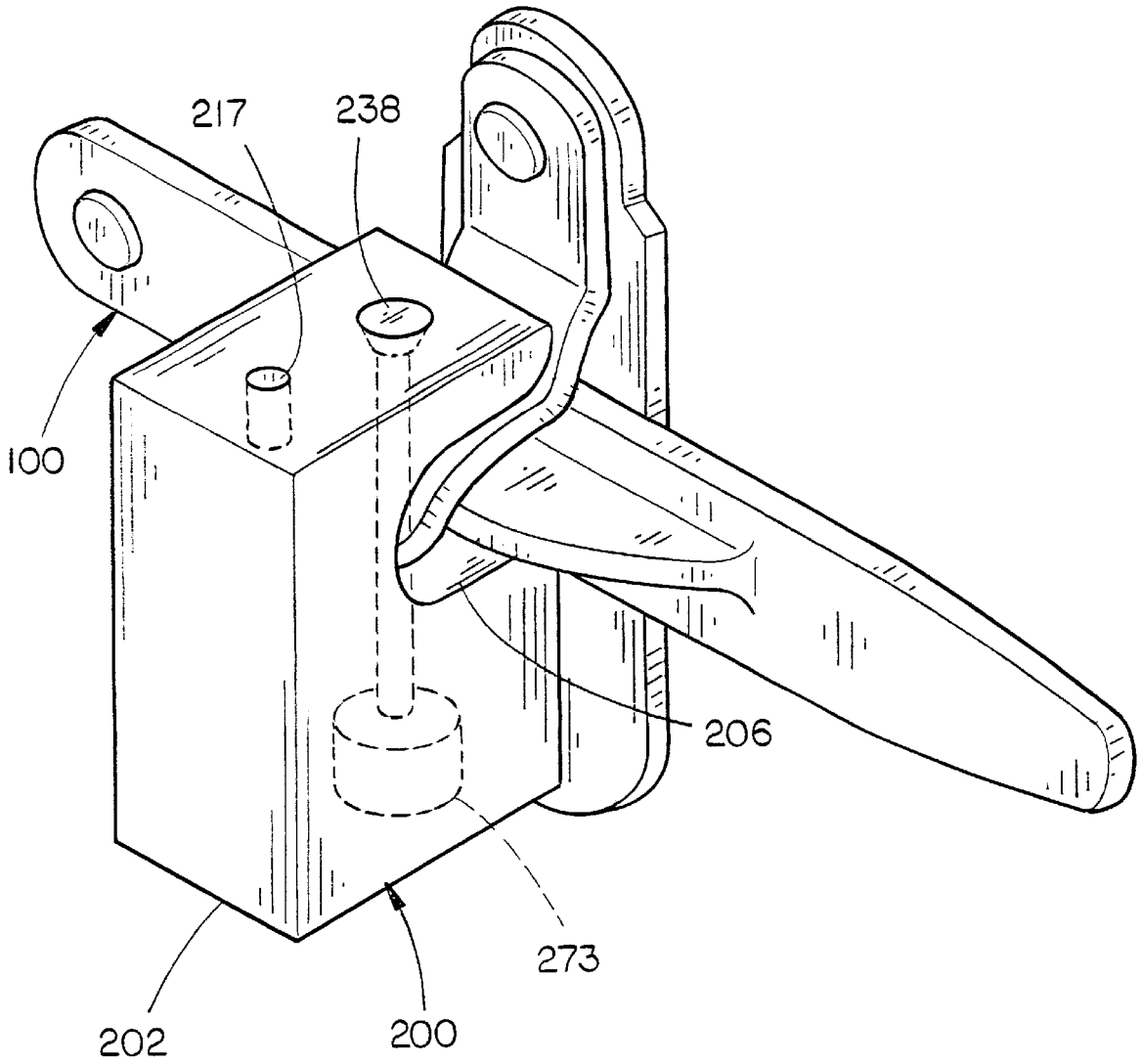
FIG. 3 shows the tamper resistant security device in position on the hasp.

FIG. 3 shows the tamper resistant security device 200 in position on the hasp 100. When the tamper resistant security device 200 is assembled, the protective cover 202 substantially encases and encloses critical components of the hasp 100, including a portion of the pivoting bar 121 and the pivoting tongue 110, for example.

During assembly, the locking cap 273 is placed into the locking cap cavity 212 with its open end facing upwards. When assembled, such as when engaged with and locking a closure device, the locking cap 273 resides fully within the protective cover 202. The protective cover 202 is placed over a hasp 100 such that the openings in the hasp 100 are disposed within the closure device cavity 206. The locking pin 230 is inserted down into the locking pin hole 207, passing through the closure device cavity 206 and through the holes or openings in the hasp 100. This may include, for example, the hole 112 in the pivoting tongue 110 and the hole 129 in the pivoting bar 121. The locking pin 230 is further inserted until the distal end 232 penetrates into the locking cap 273. When the distal end 232 of the locking pin 230 enters the locking cap 273, the snap ring 270 engages in the groove 244 in the locking pin 230. A small force will be required to force the locking pin 230 into the locking cap 273. The snap ring 270, when the tamper resistant security device 200 is fully assembled, snaps into the corresponding snap ring groove 244 on the locking pin 230.

When assembled, the head 238 of the locking pin 230 is flush with the outer surface of the protective cover 202. If the head 238 is flush with the outer surface, the locking pin 230 is therefore very highly tamper resistant. In addition, the locking cap 273 is substantially flush with the lower or bottom outer surface of the protective cover 202, giving no three-dimensional projection which a thief or vandal can grasp in order to manipulate and break the locking pin 230. The tamper resistant security device 200 therefore forms a substantially monolithic shape that substantially encases the critical portion of the hasp 100 (or other closure device) and does not have a vulnerability in the form of outward features or projections.

Depending on the clearance between the snap ring 270 and the grooves 288 and 244, the tamper resistant security device 200 may be capable of being hand assembled. Alternatively, hand tools may be required to force the locking pin 230 into place. Once the locking pin 230 is engaged with the snap ring 270, considerable force will be required to dislodge the locking pin 230. This creates a very tamper resistant security device.

The spacing in the closure device cavity 206 is such that even if a saw blade can be inserted in between the protective cover 202 and the hasp 100, the locking pin 230 will rotate and make sawing difficult. Because the head 238 of locking pin 230 is substantially flush with the upper or top outer surface of the protective cover 202, a thief will have a very hard time restraining the rotation of the locking pin 230.

Although not completely tamper proof, the tamper resistant security device 200 of the invention may make breaking and entering of a door or access port difficult, time-consuming and expensive enough that a potential thief will find defeating the tamper resistant security device 200 to be uneconomical and risky.

Figure 4:
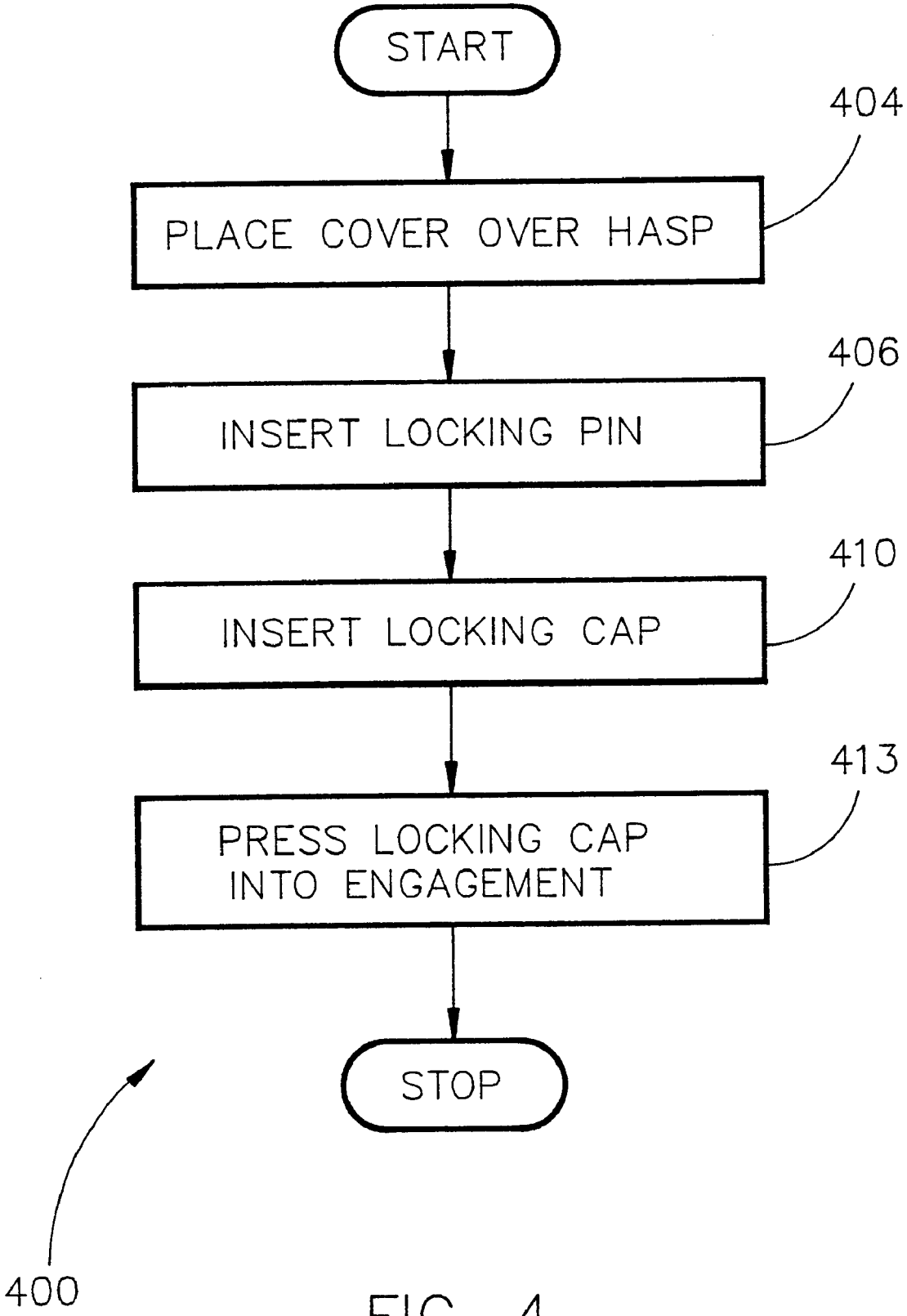
FIG. 4 is a flow chart of a method of engaging a tamper resistant security device according to the invention.

FIG. 4 is a flow chart 400 of a method of engaging a tamper resistant security device 200 according to the invention. The method may be employed to engage the tamper resistant security device with a closure device in order to lock the closure device. In step 404, the protective cover 202 is placed over a closure device, such as the hasp 100, for example. This includes aligning the locking pin hole 207 with the corresponding holes in the closure device.

In step 406, the locking pin 230 is inserted into the protective cover 202.

In step 410, the locking cap 273 is inserted into the protective cover 202. The snap ring 270 may already be in place in the groove 288 of the locking cap 273. Alternatively, the snap ring 270 may be in the groove 244 of the locking pin 230, and may snap into the groove 288 of the locking cap 273 when the distal end 232 of the locking pin 230 is inserted into the locking cap 273. It should be understood that the order of steps 406 and 410 are interchangeable and neither step must be performed first.

In step 413, the locking cap 273 and the locking pin 230 are pressed into engagement. This includes pressing the two components together until the snap ring 270 engages the groove 244 in the locking pin 230 and the groove 288 in the locking cap 273. When engaged, the locking pin 230 locks the closure device in a highly tamper resistant manner. Moreover, removal of the tamper resistant security device 200 requires specialized tools, in addition to knowledge about the construction of the tamper resistant security device 200.

Figure 5:
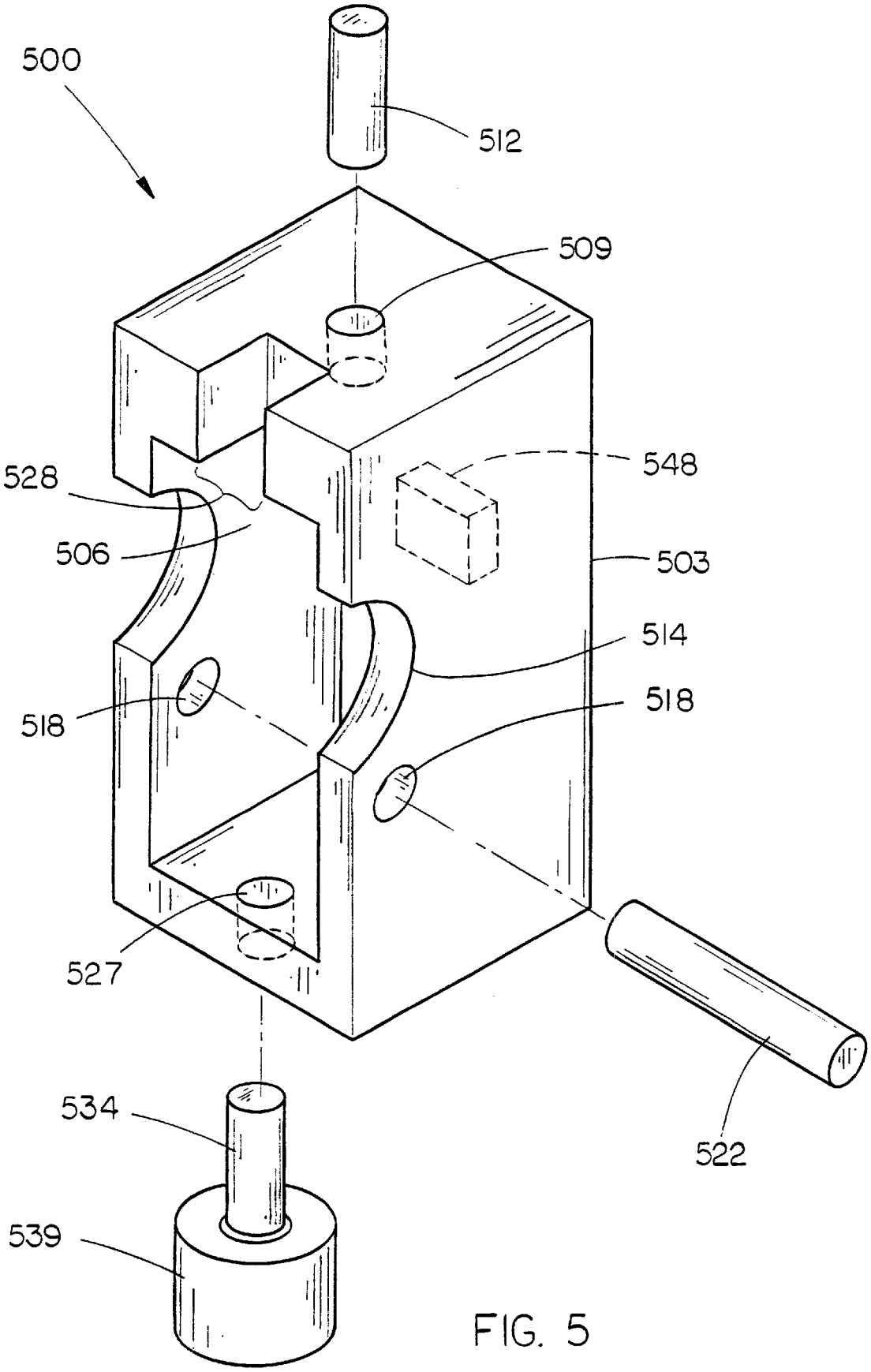
FIG. 5 shows a first embodiment of a removal tool according to the invention.

FIG. 5 shows a first embodiment of a removal tool 500 according to the invention. The removal tool 500 may be used for removing the tamper resistant security device 200. The removal tool 500 includes a body 503 including a cavity 506, a pair of cut-outs 514 in the sides of the body 503, a locking pin clearance slot 528, a first alignment pin 512, a first alignment pin hole 509, a second alignment pin 522, a pair of second alignment pin holes 518, a punch pin 534, a punch pin hole 527, and a punch pin actuator 539.

The body 503 may be a substantially rectangular shell, as shown, and may be substantially solid. Alternatively, other shapes may be used, as long as the cavity 506 fits over the protective cover 202 of the tamper resistant security device 200. The cavity 506 is of a size and shape to fit over and substantially encase the protective cover 202 of the tamper resistant security device 200, and give a minimal but adequate clearance.

The pair of cut-outs 514 are of a size and shape to accommodate the closure device. For the hasp 100, the cut-outs 514 may accommodate the pivoting tongue 110 and the pivoting bar 121 (and any projections or features formed upon the pivoting bar 121).

The locking pin clearance slot 528 corresponds to the locking pin 230. The locking pin clearance slot 528 allows the locking pin 230 to be upwardly dislodged from the protective cover 202. The locking pin clearance slot 528 may be any shape, such as rectangular, semi-circular, ovoid, irregular, etc.

The first alignment hole 509 is formed in the top of the body 503 in a position substantially in opposition to the punch pin 534. The first alignment pin 512 is supported by the body 503, and is axially movable in the first alignment hole 509. The first alignment pin 512 is therefore capable of being moved at least partially into the cavity 506. Furthermore, the first alignment pin 512 is capable of engaging the alignment hole 217 in the protective cover 202 (see FIG. 2) and retaining the removal tool 500 in a predetermined position with respect to the protective cover 202. In order to align and hold the removal tool 500 in a desired position, the first alignment pin 512 must be engaged with the protective cover 202 before the punch pin 534 is actuated.

The two second alignment holes 518 are formed in the sides of the body 503. The second alignment pin 522 may pass through the two second alignment holes 518 and is of at least a length to pass through both holes at the same time. In use, the second alignment pin 522 may be placed in position in the two second alignment holes 518, with the two second alignment holes 518 locating the second alignment pin 522 in a position between the protective cover 202 and the closure device (see FIG. 6). During disengagement, the second alignment pin 522 resides in the two second alignment pin holes 518 while the second alignment pin 522 traps the protective cover 202 in the cavity 506 of the body 503, and the protective cover 202 is therefore positioned between a back cavity surface of the body 503 and the second alignment pin 522.

The punch pin hole 527 is formed at a predetermined location to coincide with the locking pin hole 207 of the protective cover 202. The punch pin 534 may move axially in the punch pin hole 527, and may move at least partially into the cavity 506. Therefore, when the removal tool 500 is in position, the punch pin 534 travels in a substantially coaxial fashion into contact with the locking pin 230 in order to disengage the locking pin 230 from the locking cap 273. The punch pin 534 is preferably substantially equal in size to the locking pin 230, but alternatively may be smaller than the locking pin 230.

The position of the first alignment pin 512 (and the first alignment pin hole 509) is preferably on the top wall of the removal tool body 503. The position of the two second alignment holes 518 preferably are in the side walls of the body 503, such as near the center vertically and near the open end of the cavity 506. However, the alignment pin holes may be located elsewhere on the body 503, as long as they maintain the removal tool body 500 in a predetermined alignment.

The punch pin hole 527 (and the punch pin 534) is preferably located in the bottom wall, near the open end of the cavity. The punch pin hole 527 must be located so as to meet up with and be substantially coaxial with the locking pin hole 207 of the protective cover 202.

The punch pin actuator 539 may be any type of actuator capable of axially moving the punch pin at least partially into the cavity 506. This may include a hydraulic actuator, a pneumatic actuator and electrical actuator, etc., or even manual power, such as a lever, gear drive, worm gear drive, square threaded shaft and rotating threaded wheel, etc. In addition, the punch pin actuator 539 may incorporate a removable power source, such as a source of pressurized gas or fluid that is capable of driving the punch pin 534.

The punch pin actuator 539 moves the punch pin 534 and provides the force to the punch pin 534 that presses the punch pin 534 through the endwall 276 of the locking cap 273. The punch pin 534 therefore destroys the locking cap 273 by pressing through the endwall 276 and furthermore dislodges the locking pin 230 from the engagement with the snap ring 270. The punch pin 534 disengages the tamper resistant security device 200 for purposes of removal.

The removal tool 500 (or components thereof) may be made of any suitable material, but preferably something of sufficient hardness to prevent it from being easily damaged or destroyed. A high quality steel may be used, such as a 1018 steel, for example, and some form of hardening, such as case hardening, tempering, etc., may be employed on any or all of the components. Other metals may also be used, such as aluminum, and more particularly a high-strength aircraft aluminum, such as 7075-T6 aluminum.

In addition, each removal tool 500 may be formed with a unique serial number for purposes of tracking and prevention of theft, etc.

In a further security measure, each removal tool 500 may incorporate a transponder 548 that broadcasts a location signal. The location signal may be used to protect against theft or unauthorized use of the removal tool 500. The transponder 548 may be constructed anywhere on or in the removal tool 500, but preferably is constructed in an inner portion, such as in the cavity 506 and flush with an interior surface, for example. This may be done so that a thief may not easily find or access the transponder 548. If the transponder 548 is hidden within the removal tool 500, a thief may not even know that it exists and that he is being tracked.

In addition, the transponder 548 may include a GPS receiver, allowing the transponder 548 to broadcast its own location and further aiding in tracking a stolen or misappropriated removal tool 500. Although the transponder 548 is shown and described with regard to the first embodiment 500, it should be understood that a transponder 548 could be incorporated into any embodiment.

Figure 6:
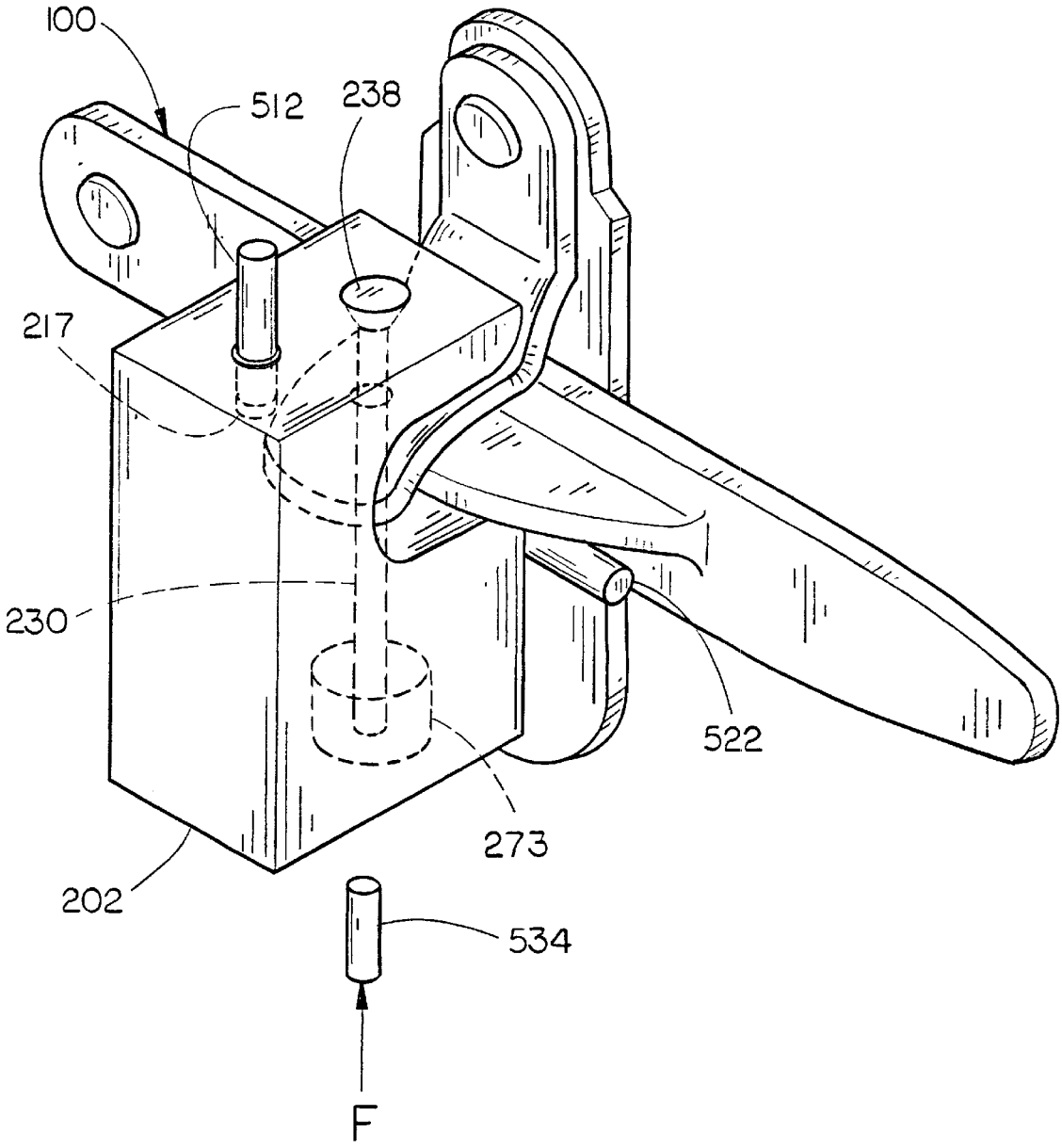
FIG. 6 shows a portion of the removal tool in position for disengagement of the tamper resistant security device.

FIG. 6 shows a portion of the removal tool in position for disengagement of the tamper resistant security device 200. For clarity, only the two alignment pins 512 and 522 and the punch pin 534 are shown, along with the tamper resistant security device 200.

As can be seen from this figure, the first alignment pin 512 of the removal tool 500 is engaged in the alignment hole 217 of the protective cover 202 (and held in the first alignment hole 509). In addition, the second alignment pin 522 is positioned between the protective cover and the closure device (and held in the second alignment pin holes 518). The removal tool 500 cannot move with respect to the protective cover due to the alignment pins 512 and 522. When aligned, the punch pin 534 is in a substantially coaxial position with the locking pin 230. As can be seen from the drawing, a force may be applied to the punch pin 534 after the alignment has been achieved. The punch pin 534 is therefore pressed under great force upward through the locking cap 273, dislodging the locking pin 230. After the locking pin 230 has been dislodged from the locking cap 273, the punch pin 534 may be retracted and the alignment pins 512 and 522 may be removed. The removal tool 500 then may be removed from around the protective cover 202 and the disengaged tamper resistant security device 200 may be removed from the closure device.

Figure 7:
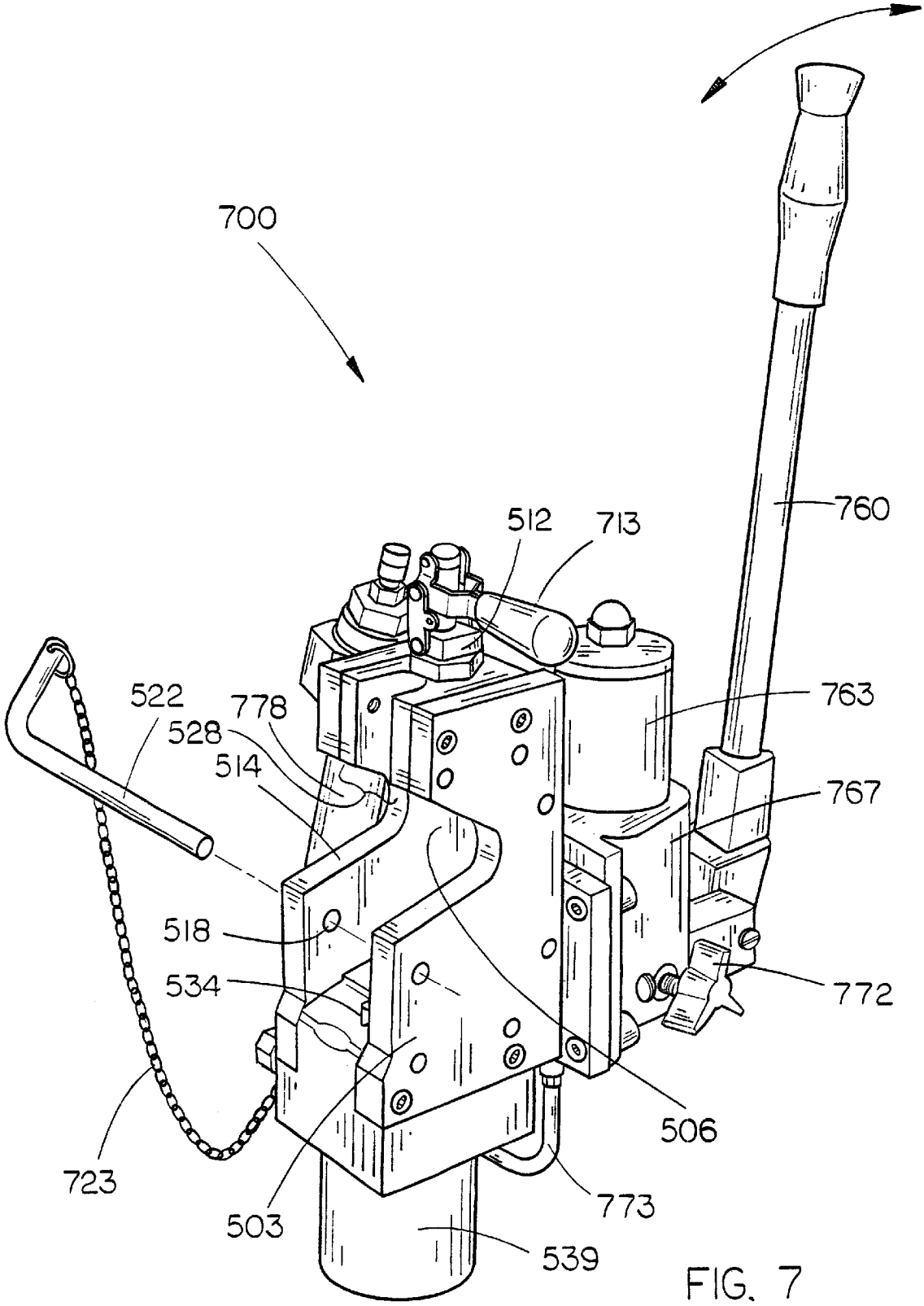
FIG. 7 shows a second embodiment of the removal tool according to the present invention.

FIG. 7 shows a second embodiment 700 of the removal tool according to the present invention. In this second embodiment, similar features retain the same identifying numbers. It should be noted that the discussion of removal tool 500 likewise applies to the removal tool 700.

In the second embodiment 700, the punch pin actuator 539 is a slave piston 539 connected to a master piston 767 by a conduit 773. The master piston 767 is manually actuated by a handle 760. The master piston 767 receives hydraulic fluid from a reservoir 763.

The removal tool 700 further includes a manually-operable valve 772. When the operational valve 772 is closed, operational movement of the handle 760 allows the master piston 767 to provide a high pressure hydraulic fluid to the slave piston 539, axially moving the punch pin 534 at least partially into the cavity 506.

The removal tool 700 may optionally include a check valve (not shown). The check valve may open at a predetermined maximum pressure, releasing the hydraulic fluid and preventing the removal tool 700 from generating a pressure greater than the predetermined maximum pressure.

The second embodiment 700 further includes a manually operated first alignment pin 512 that includes a rotatable handle 713. When the removal tool 700 is placed in a proper position for removal, by operation of the rotatable handle 713, the operator may insert or retract the alignment pin 512 into the cavity 506. Likewise, the second alignment pin 522 may be manually inserted by the operator through the two second alignment holes 518 before actuation of the punch pin 534. A chain 723 may attach the second alignment pin 522 to the removal tool 700 to prevent it from being lost.

When removal of the locking pin 230 has been completed, an operator may open the valve 772, relieving the pressure on the slave piston 539 and allowing the punch pin 534 to be retracted.

In addition, the second embodiment 700 may include an accumulator 778 that accumulates hydraulic pressure when the master piston 767 is supplying pressure to the slave piston 539. Therefore, when the valve 772 is opened by the operator at the end of a removal operation, the accumulator 778 provides an opposing hydraulic pressure to the slave piston 539, forcing retraction of the punch pin 534. This may be advantageous if the punch pin 534 is bound or frictionally held by the locking cap 273 after the locking cap 273 has been punched through.

Figure 8:
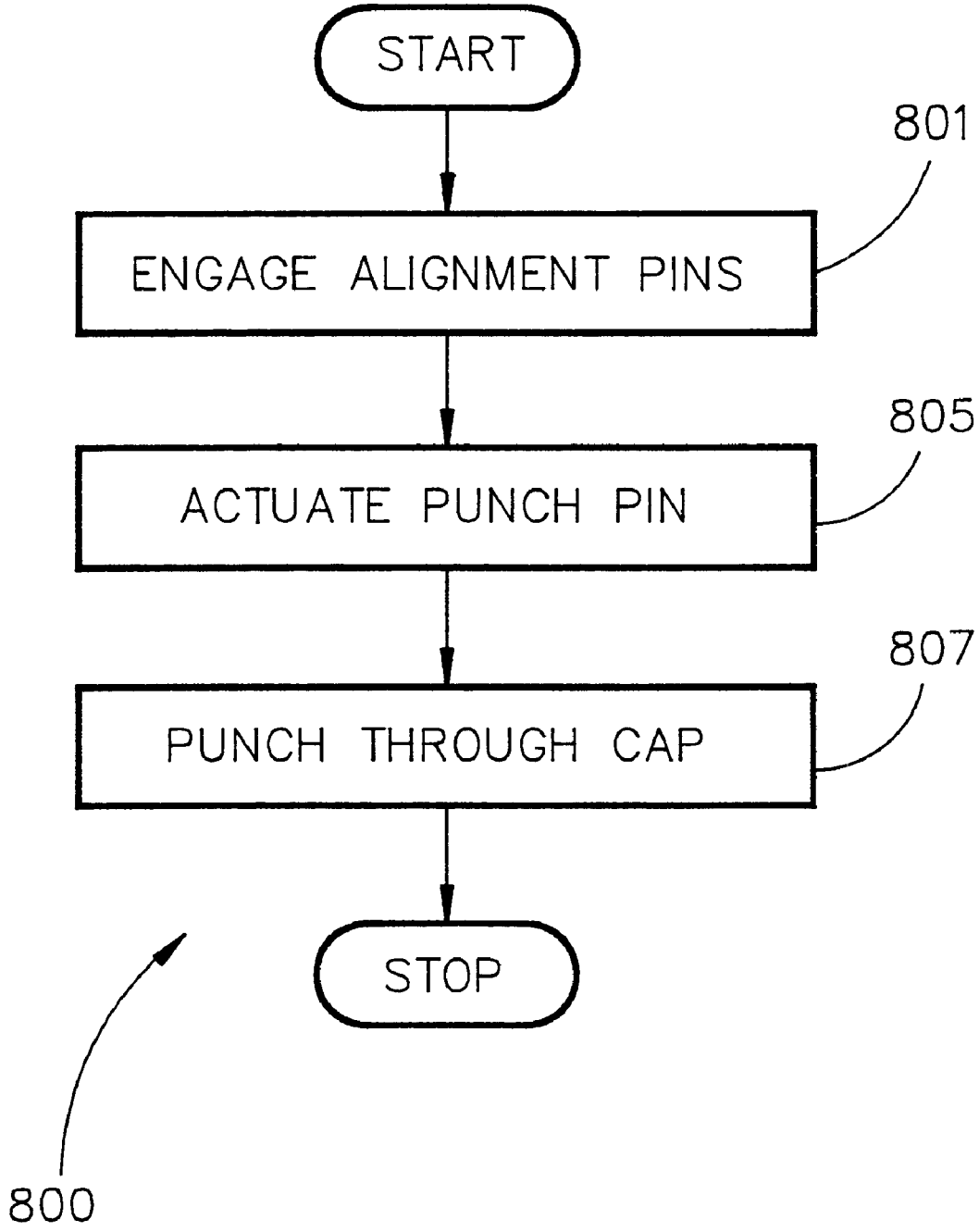
FIG. 8 is a flow chart of a method according to the invention of disengaging the tamper resistant security device using the removal tool.

FIG. 8 is a flow chart 800 of a method according to the invention of disengaging the tamper resistant security device 200 using the removal tool 500. In step 801, at least two alignment pins are engaged with the tamper resistant security device 200. Additional alignment pins may be employed, if desired. After the removal tool 500 has been placed over the protective cover 202 of the tamper resistant security device 200, the first alignment pin 512 may be moved at least partially into the cavity 506 of the removal tool 500, engaging the alignment hole 217 of the protective cover. The second alignment pin 522 may be moved into the second alignment holes 518, trapping the protective cover 202 in the cavity 506 of the removal tool 500. The protective cover 202 is therefore positioned between a back cavity surface of the removal tool body 503 and the second alignment pin 522, and the at least two alignment pins maintain the removal tool 500 in a predetermined position with respect to the tamper resistant security device 200. The removal tool 500 therefore preferably substantially encloses the tamper resistant security device 200 during disengagement of the locking pin 230.

In step 805, the punch pin 534 of the removal tool 500 is actuated. At this point, with the removal tool 500 being in proper alignment, the punch pin 534 is substantially coaxial with the locking pin 230, and is moved substantially axially toward the locking cap 273 and the locking pin 230.

In step 807, the punch pin 534 punches through the locking cap 273 to dislodge the locking pin 230 from the locking cap 273. The removal tool 500 therefore provides a punching force sufficient to punch through the locking cap 273 and dislodge the locking pin 230, disengaging the tamper resistant security device 200.

After the locking pin 230 has been disengaged, the removal tool 500 may be taken off, the locking pin 230 may be removed from the protective cover 202, and the protective cover 202 may be removed from the closure device. The closure device is now unlocked.

Preferably, removal of the tamper resistant security device 200 takes about one-half to one minute to engage, and more preferably takes less than about 35 seconds to disengage.

The punching force is comprised of both a force required to punch through the locking cap 273 and a force required to unseat and/or deform the snap ring 270. For example, using a locking cap made of 12L14 steel, several tests were performed to see how the thickness of the endwall 276 affected the required force. For an endwall thickness of 0.045 inch, the average force was 4,166 pounds per square inch; for an endwall thickness of 0.055 inch, the average force was 4,866 pounds per square inch; for an endwall thickness of 0.065 inch, the average force was 5,133 pounds per square inch; and for an endwall thickness of 0.075 inch, the average force was 5,300 pounds per square inch.

In one embodiment, removal of the locking pin 230 from the locking cap 273 requires about 2,500 to about 3,000 pounds per square inch of force. This is generally greater than the force that can be manually generated using a hammer or other hand tools. However, the amount of force may be adjusted as desired, and may take into account the size and contents of the container, the cost of the components of the tamper resistant security device 200, etc. The required force may be set to any predetermined amount through choice of the type of material used to make the components, the relative sizes of the components, and the relative clearances between the snap ring 270, the groove 244, the groove 288, and the locking pin 230.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A tamper resistant security device for a closure device, comprising:

a locking pin including a head, a shaft extending from said head, and a groove formed in said shaft;

a locking cap comprising a blind hole, a groove formed inside and substantially coaxial with said blind hole, and a snap ring fitting within said groove and capable of snapping into said groove of said locking pin; and a protective cover comprising a closure device cavity, said closure device cavity being configured to receive said closure device with minimal clearance in order to substantially prevent access to said closure device, a locking pin hole extending through said protective cover, a locking cap cavity, and an alignment hole;

wherein when assembled said protective cover is placed over said closure device, said locking pin passing through said locking pin hole and extending through said locking pin hole and said cavity into said locking cap, and said locking cap is placed in said locking cap cavity and said snap ring of said locking cap is retained in said locking groove of said locking pin;

wherein said closure device cavity is of a size and clearance to substantially prevent access to said closure device when assembled on said closure device; and wherein only said head of said locking pin and a substantially flat end of said locking cap are exposed when said locking pin, said locking cap, and said protective cover are assembled.

2. The tamper resistant security device of claim 1, wherein said closure device is a hasp and said closure device cavity is configured to receive said hasp.

3. The tamper resistant security device of claim 1, wherein said closure device is a hasp and said closure device cavity is of a predetermined shape, said predetermined shape including a substantially convex upper surface, an essentially flat rear surface, and an essentially concave lower surface that give a minimal clearance between said upper, rear, and lower surfaces of said closure device cavity and a closure device.

4. The tamper resistant security device of claim 1, wherein said locking pin hole is countersunk to receive said head of said locking pin.

5. The tamper resistant security device of claim 1, wherein said head of said locking pin is substantially flush with an outer surface of said protective cover when said tamper resistant security device is assembled.

6. The tamper resistant security device of claim 1, wherein said head of said locking pin is tapered and said locking pin hole is countersunk to receive said head of said locking pin.

7. The tamper resistant security device of claim 1, wherein said locking cap is substantially flush with an outer surface of said protective cover when said tamper resistant security device is assembled.

8. The tamper resistant security device of claim 1, wherein said tamper resistant security device is formed of metal.

9. The tamper resistant security device of claim 1, in said tamper resistant security device is formed of a hardened metal.

10. The tamper resistant security device of claim 1, wherein said tamper resistant security device is formed of 1018 steel.

11. The tamper resistant security device of claim 1, wherein said locking cap includes an endwall of a predetermined thickness chosen to prevent punch-through at a pressure less than about one thousand pounds per square inch.

12. A removal tool for disengaging a tamper resistant security device, comprising:

a body including a cavity capable of receiving a tamper resistant security device comprising a protective cover, a locking pin, and a locking cap;

a punch pin hole formed in a wall of said body and a punch pin supported by said punch pin hole and axially movable at least partially into said cavity;

a punch pin actuator communicating with said punch pin and capable of axially moving said punch pin;

a first alignment pin and a first alignment pin hole positioned in said body and supported by said body and axially movable at least partially into said cavity, with said first alignment pin capable of engaging an alignment hole in said protective cover and operating to retain said removal tool in a predetermined position with respect to said protective cover; and a second alignment pin and two second alignment pin holes formed in opposite sides of said body, so that during disengagement said second alignment pin resides in said two second alignment pin holes while said second alignment pin traps said protective cover in said cavity of said body, and said protective cover is therefore positioned between a back cavity surface of said body and said second alignment pin;

wherein said punch pin, driven by said punch pin actuator is capable of punching through said locking cap, dislodging said locking pin from said locking cap, and thereby disengaging said tamper resistant security device.

13. The removal tool of claim 12, wherein said punch pin hole is located substantially in opposition to said first alignment hole.

14. The removal tool of claim 12, wherein said punch pin is substantially equal in size to said locking pin.

15. The removal tool of claim 12, wherein said punch pin actuator is a hydraulic actuator.

16. The removal tool of claim 12, wherein said punch pin actuator is a hydraulic actuator and includes a valve that allows said punch pin to be returned to a retracted position.

17. The removal tool of claim 12, wherein said punch pin actuator is a hydraulic actuator and includes a pressure accumulator that substantially retracts said punch pin when said hydraulic actuator is disabled.

18. A method of disengaging a tamper resistant security device using a removal tool, with said tamper resistant security device comprising a protective cover, a locking pin, and a locking cap, said method comprising the steps of:

engaging at least two alignment pins to hold said removal tool in a predetermined position with respect to said protective cover;

actuating a punch pin to move axially into contact with said locking cap; and punching through an endwall of said locking cap to dislodge said locking pin from said locking cap;

wherein said removal tool provides a punching force sufficient to punch through said locking cap and dislodge said locking pin.

19. The method of claim 18, further comprising a step of retracting said punch pin from said locking cap.

20. The method of claim 18, wherein said dislodging includes unseating a spring clip that engages a groove in said locking pin and a groove in said locking cap.

21. The method of claim 18, wherein said dislodging includes deforming and unseating a spring clip that engages a groove in said locking pin and a groove in said locking cap.

22. The method of claim 18, wherein said punching force is provided by a punch pin actuator.

23. The method of claim 18, wherein said punching force is provided by a hydraulic punch pin actuator.

24. A method of engaging a tamper resistant security device with a closure device in order to lock said closure device, with said tamper resistant security device comprising a protective cover, a locking pin, and a locking cap, comprising the steps of:

placing said protective cover over said closure device, said protective cover including a closure device cavity that substantially encloses at least a portion of said closure device;

inserting a locking pin through a locking pin hole in said protective cover, said locking pin being capable of passing through corresponding apertures in said closure device in order to lock said closure device, with a distal end of said locking pin being thereby positioned within a locking cap cavity in said protective cover;

inserting a locking cap into said locking cap cavity in said protective cover and over said distal end of said locking pin; and pressing said locking cap onto said locking pin until a snap ring positioned in a groove in said locking cap engages a corresponding snap ring groove in said distal end of said locking pin;

wherein said protective cover locks and substantially encloses said closure device.

25. The method of claim 24, wherein after insertion a head of said locking pin is substantially flush with an outer surface of said protective cover.

26. The method of claim 24, wherein after insertion said locking cap is substantially flush with an outer surface of said protective cover.

27. The method of claim 24, wherein said closure device is a hasp.

* * * * *